US007152384B1

(12) United States Patent
McCarty

(10) Patent No.: US 7,152,384 B1
(45) Date of Patent: Dec. 26, 2006

(54) DOME KIT, STRUCTURE AND METHOD

(76) Inventor: Gerald Joseph McCarty, 1037 S. Alvernon Way, Ste. 250, Tucson, AZ (US) 85711

( * ) Notice: Subject to any disclaimer, the term of this patent is extended or adjusted under 35 U.S.C. 154(b) by 0 days.

(21) Appl. No.: 10/659,615

(22) Filed: Sep. 10, 2003

Related U.S. Application Data

(60) Provisional application No. 60/409,415, filed on Sep. 10, 2002.

(51) Int. Cl.
*E04B 1/32* (2006.01)
*E04B 7/10* (2006.01)

(52) U.S. Cl. ..... 52/639; 52/644; 52/81.3; 52/81.1; 52/82; 52/80.2

(58) Field of Classification Search ..... 52/80.1, 52/82, 83, 80.2, 292, 745.07, 237, 245, 246, 52/81.2, 81.3, 639, 644
See application file for complete search history.

(56) References Cited

U.S. PATENT DOCUMENTS 2,582,723 A * 1/1952 Stemmons et al. ..... 52/81.4
3,270,470 A * 9/1966 Wilkie, et al. ..... 52/82
3,633,547 A * 1/1972 Stevens et al. ..... 119/447
3,894,367 A * 7/1975 Yacaboni ..... 52/81.2
3,916,589 A * 11/1975 Richter ..... 52/81.3
3,999,336 A * 12/1976 Bance ..... 52/81.3
3,999,337 A * 12/1976 Tomassetti et al. ..... 52/82
4,244,152 A * 1/1981 Harper, Jr. ..... 52/81.3
4,245,809 A * 1/1981 Jackson ..... 249/15
4,260,276 A * 4/1981 Phillips ..... 403/172
4,357,782 A * 11/1982 Peter ..... 52/18
4,400,927 A * 8/1983 Wolde-Tinase ..... 52/745.08
4,402,422 A * 9/1983 Honath et al. ..... 220/327
4,488,392 A * 12/1984 Pearcey et al. ..... 52/741.11
4,541,210 A * 9/1985 Cook ..... 52/82
4,671,693 A * 6/1987 Rossman ..... 403/174
4,698,941 A * 10/1987 Rieder et al. ..... 52/81.3
4,720,947 A * 1/1988 Yacaboni ..... 52/81.3
5,067,288 A * 11/1991 Takahama et al. ..... 52/61.2
5,130,915 A * 7/1992 Lerch ..... 382/367
5,146,719 A * 9/1992 Saito et al. ..... 52/80.1
5,170,599 A * 12/1992 Knight ..... 52/91.1
5,202,361 A * 4/1993 Zimmerman et al. ..... 52/39
5,313,763 A * 5/1994 Oram ..... 52/80.2
5,371,983 A * 12/1994 Kawaguchi et al. ..... 52/81.1
5,440,840 A * 8/1995 Levy ..... 52/83
5,502,928 A * 4/1996 Terry ..... 52/80.1
5,724,775 A * 3/1998 Zobel et al. ..... 52/82
5,857,294 A * 1/1999 Castro ..... 52/81.2
6,282,842 B1 * 9/2001 Simens ..... 52/2.11
6,324,792 B1 * 12/2001 DeGarie ..... 52/80.1
6,748,712 B1 * 6/2004 Likozar et al. ..... 52/506.07

* cited by examiner

*Primary Examiner*—Jeanette Chapman
(74) *Attorney, Agent, or Firm*—Lawrence R. Oremland, P.C.

(57) ABSTRACT

A new and useful Dome Kit, dome shaped structural system and method of assembling a dome shaped structural system are provided. The Dome Kit and method are used to form a dome shaped structural system comprising a compression ring, a lower ring that is larger than the compression ring and spaced below the compression ring, and a plurality of ribs connected with the compression ring. The lower ring, the compression ring, lower ring and connected ribs form a dome shaped structural system; i.e. a structural system with a dome shaped appearance.

7 Claims, 4 Drawing Sheets

DOME KIT, STRUCTURE AND METHOD

RELATED APPLICATION/CLAIM OF PRIORITY

This application is related to and claims priority from U.S. provisional application Ser. No. 60/409,415, filed Sep. 10, 2002, which provisional application is incorporated by reference herein.

BACKGROUND AND SUMMARY

Within the design build industry there have been attempts to construct an on site dome using carpenters and scaffold. The results have been marginal at best in achieving a uniform roof system such as a dome. While absorbing high labor costs and excessive waste of materials the outcome is often unpredictable both in the control of the craftsmanship and the conveyance of strength through the system. This kind of performance gives the Architect or designer a real challenge. How can he project his finishes when there is such little control of the materials?

The solution is to use a Dome Kit of the type provided by the present invention. The kit has a uniform system of parts that when assembled into a dome shaped structural system, does provide a predictable cost and understandable resolve in dimensions, strength and options for aesthetic and code related concerns. In using the Dome Kit you can determine the response needed to handle loads and other reactive forces acting through the roof diaphragm. This is particularly useful to professional engineers in designing and constructing dome shaped structural systems, i.e. structural systems that are dome shaped, and designed to handle the types of loading to which building structures are subjected.

The placement of a dome shaped structural system produced with a Dome Kit, according to the present invention, may be used as an integrated system within other roofing systems commonly associated with the residential and commercial building industry. It can be used creatively in achieving a variety of interior environments and exterior elevations. The Dome Kit responds to the larger building industry as well as the home owner or do-it-yourself individual. The Dome Kit offers a predictable project cost and provides many other options.

In the concrete monolithic type dome the routing of mechanical air supply ducting or electrical fixture distribution is not possible. The same goes for the plastic and glass domes. The concrete, plastic and glass domes have an absence of insulation quality and an inability to integrate easily into adjacent horizontal and vertical building assemblies. The Dome Kit allows options in each of these areas. The compression ring at the top of the dome kit also offers an opening for a skylight or a cupola.

The Dome Kit was developed from the applicant's personal need to have such a product. As a designer and builder the applicant could not find such a product from the market that serves the building industry. Applicant also wanted to satisfy the following objectives;

1. Create a uniform building system for dome shaped structural systems.

2. Provide the Architect, the Builder and the Home Owner, a kit for building a dome shaped structural system that can be specified in the proposed building plans and be successfully incorporated into a building structure.

3. Provide options for mechanical, electrical and natural light systems within a dome type structure. A dome shaped structural system produced from the Dome Kit preferably includes ribs that are formed of wood and have spaces between adjacent ribs, so that mechanical, electrical and/or natural light systems can be located in those spaces, and, if desired, conveniently connected to the ribs.

4. To satisfy the 2000 International Residential Code with the ability for an R-38 insulation value that within the dome becomes contiguous and equal to the insulation value in the adjoining roof assembly.

5. To assign a predetermined strength to the individual components of the Dome Kit, whereby the options for varied elevations and diameters of dome shaped structural systems produced from the Dome Kit can be achieved easily.

6. To have options for achieving exterior finishes based on the project budget, project setting and overall aesthetic intent. This can be readily carried out knowing that a dome shaped structural system produced from the "Dome Kit" can be roofed with multiple choices in roofing systems.

These and other features of the present invention will become further apparent from the following detailed description and the accompanying drawings.

At the end of the following detailed description there is a Parts List of the various parts that are illustrated in the Figures and referenced in the detailed description.

DETAILED DESCRIPTION OF THE INVENTION

Figure 1A:
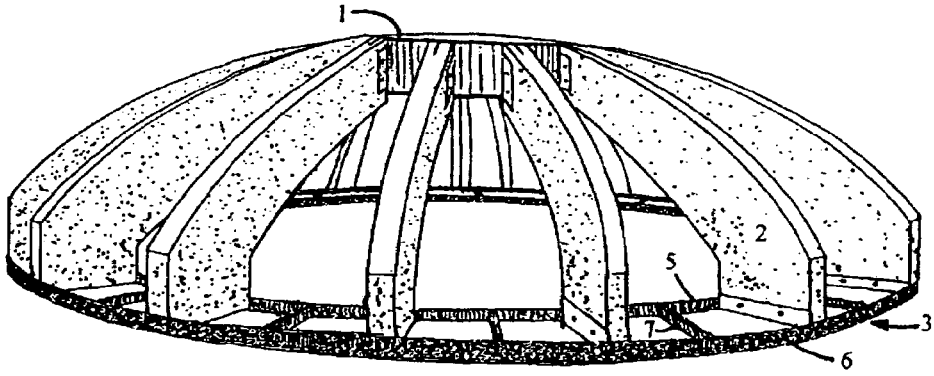
FIG. 1A is a schematic, perspective illustration of a dome shaped structural system assembled from a "Dome Kit", according to the principles of the invention. The main elements are the compression ring, ribs and lower ring.
Figure 4A:
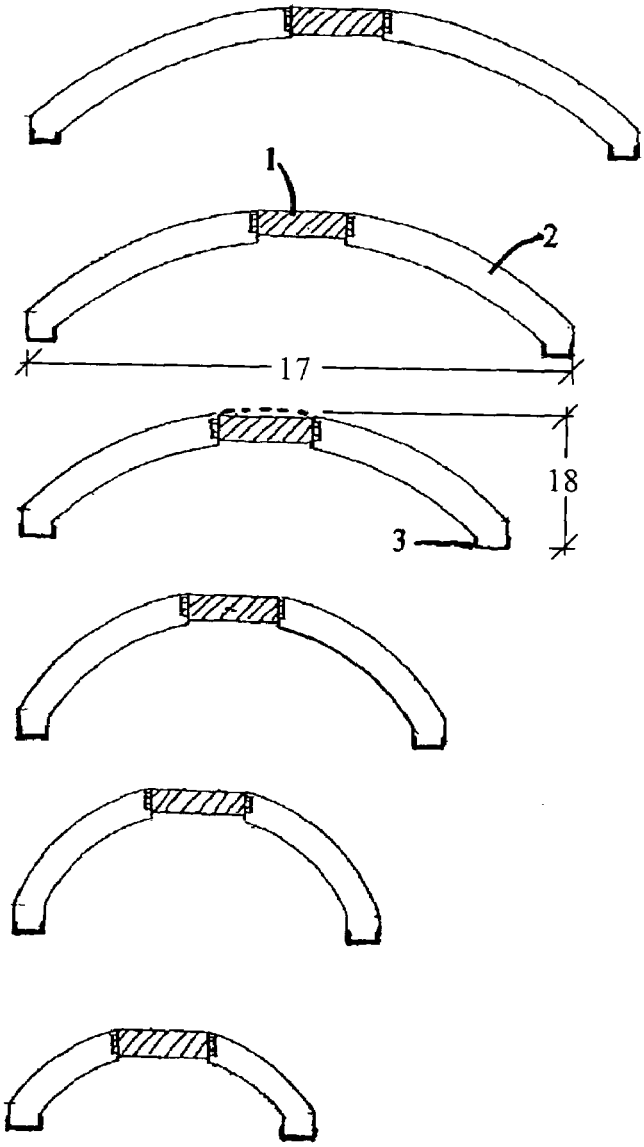
FIG. 4A schematically illustrates several cross sections of dome shaped structural systems, to convey that the Dome Kit enables dome shaped structural systems to be made with different heights and diameters.

The "Dome Kit" is a kit, preferably of wood and steel parts that are assembled to make a dome shaped structural system of the type shown in FIG. 1A. The Dome Kit can be designed to produce dome shaped structural systems in a variety of elevations and diameters (see e.g. FIGS. 4A, 4B).

All parts for forming a dome shaped structural system are preferably included in the kit. The kit also preferably includes text and drawings that provide a clear and concise method for assembly of the parts into the dome shaped structural system. The context for which the Dome Kit is used by others and the purpose behind this written explanation for assembly relates to the individual or individuals who will be assembling it. Whether or not the builder is directly involved in the assembly, the builder should be available for consultation as to where the assemblers set up. The builder who will be moving and placing the dome shaped structural system after it is fully assembled must be aware of the logistics involved and coordinate his efforts with those of the assemblers. The moving and placing of a fully assembled dome shaped structural system is not considered part of the Dome Kit use or assembly.

The three main components of a dome shaped structural system assembled from a Dome Kit are the compression ring 1, wood ribs 2 and the lower steel ring 3 (see e.g. FIG. 1A). The assembly begins with assembly of the lower steel ring 3. The lower steel ring 3 comprises inner 5 and outer 6 steel rings that are concentric to each other and is formed from two or more lower ring sections, each of which comprises an inner ring part and an outer ring part. The inner and outer ring parts are joined together by gussets 8 located at the ends of the ring sections, steel angles 15 and by gussets 7 located between the ends of the ring sections (see e.g. FIGS. 1B, 1C, 3C). The steel gussets 7, 8 and steel angles 15 are welded on both sides to the inner and outer ring parts (see e.g. welds 9) and all the welding is done at the factory. There is no welding required on site as the parts are being assembled to form the dome shaped structural system.

Figure 1B:
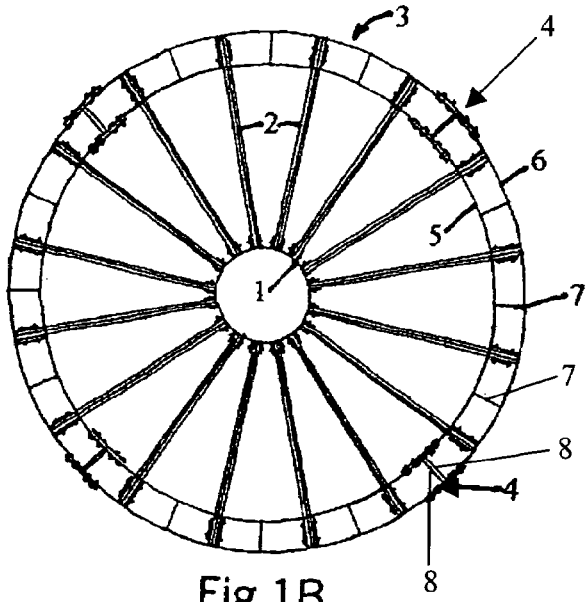
FIG. 1B is a schematic plan view of a dome shaped structural system, with a 16 rib layout showing again the compression ring, wood ribs and lower steel rings. The splice assembly is added so the reader is informed that the lower rings are manufactured in sections and are required to be constructed into a circular format. This drawing builds upon FIG. 1A to show the uniform parts that are used to construct this dome shaped structural system.
Figure 1C:
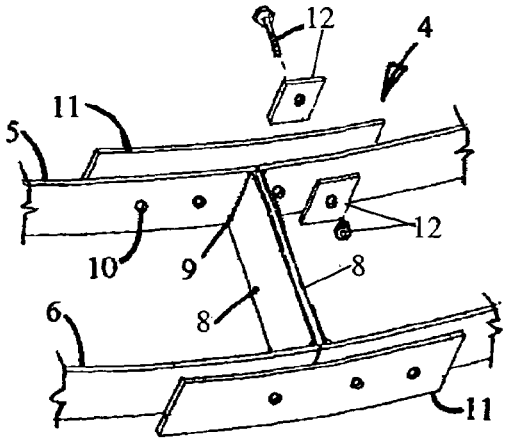
FIG. 1C is a schematic, perspective view of a splice assembly, showing how the lower steel ring sections are joined. This enables the assembler to have reference for assembling the lower ring, which is the first step in the assembly of the dome shaped structural system. This drawing builds upon a typical location for the splice assembly shown in FIG. 1B and offers detail of the parts to be used.
Figure 2A:
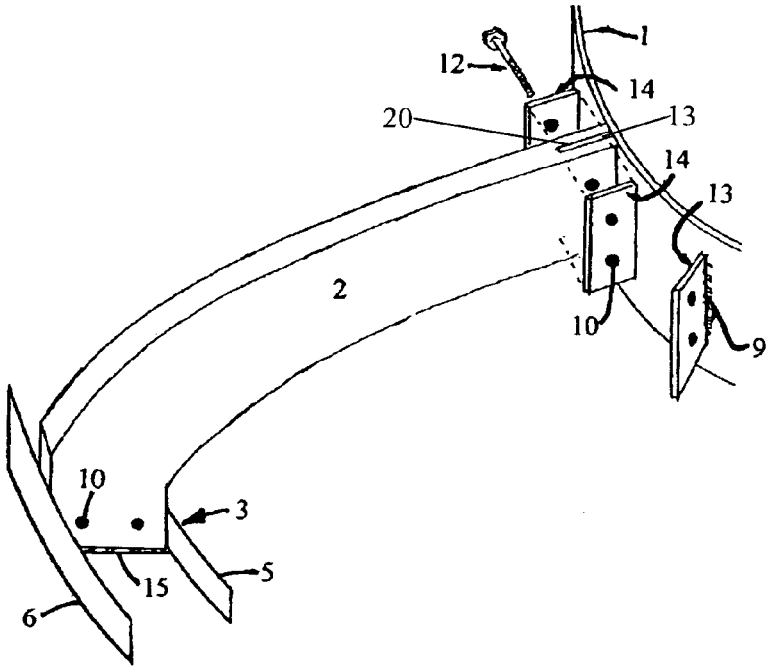
FIG. 2A is a schematic, partial, three dimensional view of the lower portion of the wood rib being placed into the lower steel rings and the upper rib fastening at the compression ring. The wood rib is expressed in a non scaled manner. Given the customers request for a specific diameter and height for a dome shaped structural system the final length and elevation for the rib can be determined.
Figure 2B:
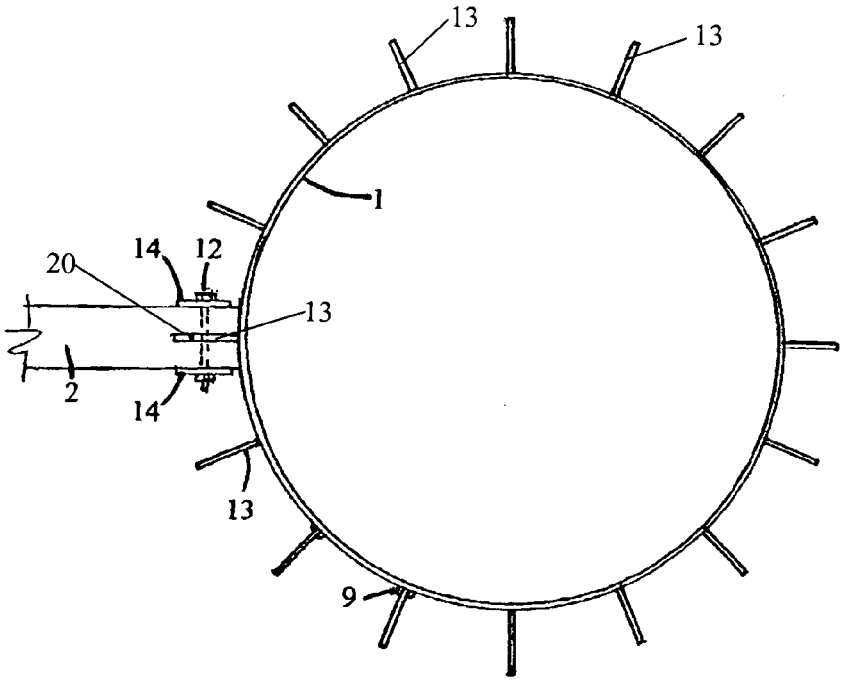
FIG. 2B is a schematic, plan view of a compression ring showing the rib mounting flanges for connecting the ribs. This drawing builds on FIG. 2A as it shows the uniformity of equal divisions between each rib-mounting flange. This also gives the reader visual information that he will have to accomplish all connections in order to assemble the dome shaped structural system. The compression ring is illustrated as it comes from the factory with mention of where the factory welds are taken.

In FIG. 1B a completely assembled dome shaped structural system is shown in plan view. To use this as an example the lower steel ring 3 is first assembled from the ring sections, by splicing ring sections together using splice assemblies 4 (FIGS. 1B, 1C). In FIG. 1B the lower steel ring 3 is constructed from four smaller ring sections, using the splice assembly 4 (The splice assembly 4 is shown in more detail in FIG. 1C). The lower ring sections are to be placed flat on the ground or a concrete slab. The lower steel ring sections will have a factory mark at each end that will match the adjoining end of the next lower steel ring section in sequence. Correctly move the sections into a circle by matching the ends so that the adjoining gussets 8 at the ends of the adjacent ring sections look like FIG. 1C. Join the sections by using the splice assembly 4 comprised of two splice plates 11 and nuts, bolts and washers 12. Adjoining gussets 8 at the ends of the adjacent ring sections are not fastened directly to each other, but are connected with each other via the splice assemblies.

Initially, all bolting at the splice assemblies 4 should be loose fitting to ensure alignment at all splice plates 11 prior to final tightening. Using the splice plate 11 insert the ⅝" bolts 12 so that the threaded portion of the bolt goes to the inside of the lower steel rings. With the lower ring sections assembled follow the next step.

Study the FIGS. 2A through 3C. Become familiar with the fitting of the wood rib 2 both at the lower steel ring 3 and at the rib-mounting flange 13 located at the outer perimeter of the compression ring 1. The Dome Kit is supplied with the same quantity of wood ribs 2 as there are 4" steel angles 15 at the lower steel ring 3 and the same quantity of rib mounting flanges 13 at the compression ring 1. All rib mounting flanges 13 are factory welded to the compression ring (see e.g. welds 9). The ribs 2 are preferably of a type having a structural strength that is suitable for the intended application. In many areas, type DF (Douglas Fir) woods will have such strength.

The assembler will need to position the compression ring 1 at the appropriate height in the exact center of the lower steel ring 3. Use an apparatus such as a pair of saw horses or a mounting block. The mounting apparatus, blocking and shims are not included in the Dome Kit. Place them on the ground, at the center of the lower steel ring 3. Adjust the apparatus to the desired height which will be the dome's elevation 18 or 19 (FIGS. 4A, 4B) less 12 inches. The top of the compression ring 1 will be labeled. Place the compression ring 1 on the mounting apparatus. Be accurate as possible when situating the compression ring 1. Use the center point of the dome diameter 17 to align with the center point of the compression ring diameter. Once achieving this, the next step is to visually or by a mechanical device, align the rib mounting flanges 13 in the same plane as the 4" steel angles 15 located in the lower steel rings 3. This will ease the placement of the ribs 2 in the next step. It is helpful to study FIGS. 2A and 2B.

Figure 3A:
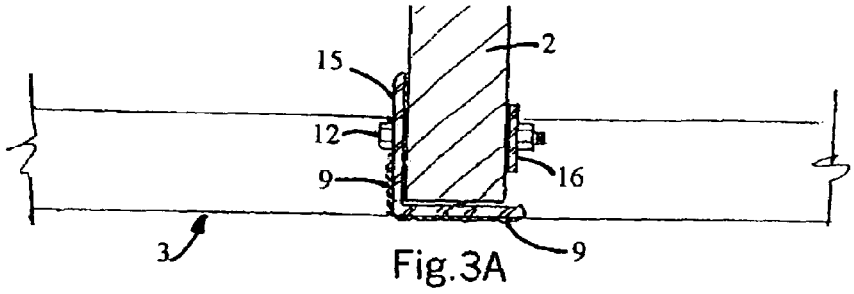
FIG. 3A is a partial, schematic cross sectional view showing one of three views of how the lower portion of the wood rib seats and fastens into the steel angle. The 4" steel angle is factory welded into the lower steel ring. Factory weld locations are noted.
Figure 3B:
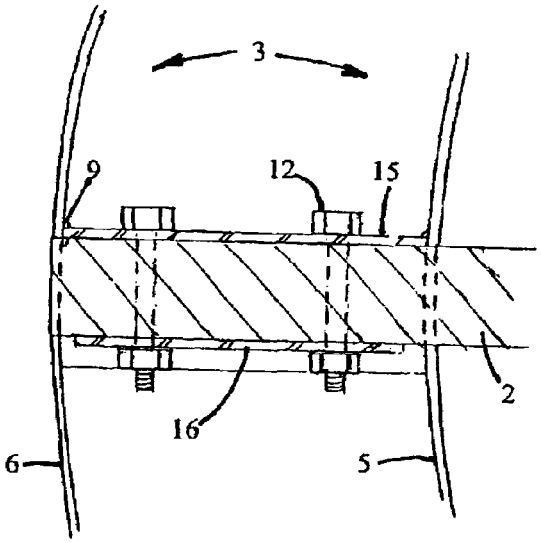
FIG. 3B is a partial schematic plan view and demonstrates the full bolt up for the lower portion of the wood rib. It builds upon FIG. 3A with a different view of the bolting. The familiarity of the two concentric lower steel rings and associated parts is important to study before beginning the rib installation process.
Figure 3C:
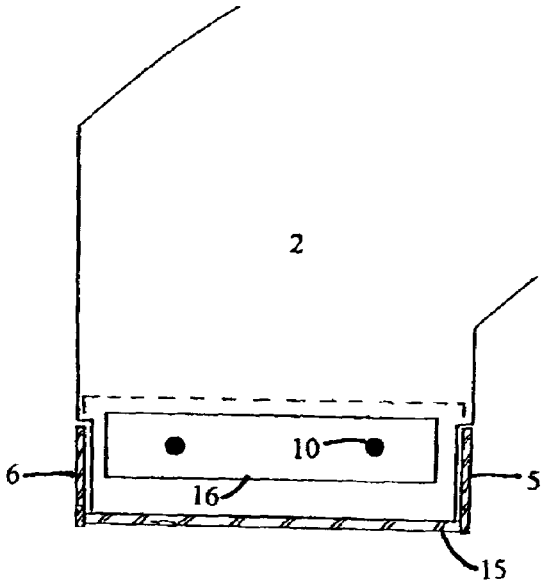
FIG. 3C is a schematic, partial cross section through the lower steel rings and the wood rib and builds upon FIG. 3A and FIG. 3B. The use of the steel backup plate with factory ready bolt holes is shown. The inner and outer steel rings that make up the lower steel rings are noted. The wood rib always measures 3" wide×12" deep. The lower portion of the wood rib depth is notched to a net dimension of 11¼" to easily fit into the net inner dimension of the lower steel rings which is 11½". The net outer dimension or width of the lower steel rings is 12".

To assemble the ribs 2 into the structure, begin by placing a first set of wood ribs 2 into the lower steel ring 3 (one set of ribs equals two ribs). The lower portion of wood rib depth is notched (FIG. 3C), so that the net dimension is 11¼" and will seat into the lower steel ring 3 that has net inside dimension in-between the inner 5 and outer 6 lower rings of 11½". With a wood rib 2 in hand, place the lower portion of the wood rib 2 into the lower steel ring 3 at the location where you find a 4" steel angle 15. Be sure to place the rib 2 along side of the vertical side of the steel angle 15 and on top of the horizontal portion of the steel angle 15 (FIG. 3A). Gently swing the rib 2 in a hinging motion toward the rib mounting flanges 13 at the compression ring 1. Have a second person on the opposite side of the ring to stabilize the compression ring 1 while this action is taking place. The upper end of each wood rib has a slot 20 (FIGS. 2A, 2B) that is configured to receive a rib-mounting flange 13. When a rib 2 is positioned on the steel angle 15, and swung toward the rib mounting flanges, the slot 20 in the rib will receive the rib-mounting flange 13 that is aligned with the steel angle 15. After positioning the wood rib 2 lower portion and the top portion in the foregoing manner, make sure the connection is flush at the metal parts receiving the wood rib.

Use the ⅝" bolts, nuts, washers 12 and steel backup plates 14 and 16 provided in the Dome Kit to secure the rib to the rib mounting flange 13, thereby coupling the upper end of the rib with the compression ring 1. Boltholes 10 are provided factory ready at both ends of the wood rib 2, the 4" angle 15, the rib-mounting flange 13 and all of the steel backup plates 14 and 16. Loosely bolt the connections FIGS. 3A, 3B. Place and secure the second rib of the set of ribs at the opposite location (i.e. along the same diameter but on the opposite side of the compression and lower rings) using the same method described above.

One set of ribs equals two ribs. Three sets of ribs equals six total. Always position one rib across from the other when beginning the assembly. After positioning the first or the second set of ribs, depending on the accuracy first taken by the assemblers, it may be useful to adjust the support dimension below the compression ring 1 by adding or subtracting wood blocks or shims to obtain a reasonable height 18 for achieving the rib 2 placement.

The second set of wood ribs 2 should be at 90 degrees or a right angle to the first set. This will help level and secure the compression ring 1. Be sure of the alignment and the fitting on both axis's at this time. Now the bolting should be made snug at the compression ring 1 and lower steel ring 3 connections FIGS. 3A, 3B. After placing three or four sets of wood ribs 2 the compression ring 1 becomes self-supporting. The sawhorses or mounting block can be removed to allow completion of the wood rib 2 installation. Using an adjustable or socket wrench the tightening of all connectors can be easily accomplished. The dome shaped structural system is now ready for the builders use.

Figure 4B:
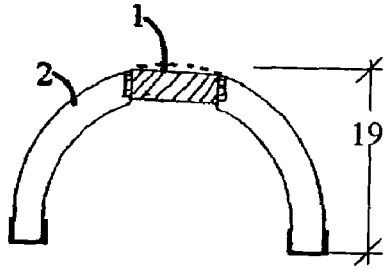
FIG. 4B shows a schematic cross section through a dome structure where the elevation is one half the diameter. As in FIG. 4A the use of the ribs, compression rings and lower rings, in combination offers a consistent level of uniformity when subjecting the engineering to varied elevations and diameters.

If the dome shaped structural system being assembled is similar to FIG. 4B then a suggested mounting apparatus could be a metal scaffold with adjustable heights and the use of wood blocks and shims.

It is believed the following additional comments will be useful to those in the art.

1. In the 10 foot to 36 foot range of "dome kit" offering, the rib dimensions remain constant at 3 inches by 12 inches. They grow or shrink in curvature and length per each customer order.

2. The lower rings 3 remain the same. A ¼ inch by 3 inch flat stock steel is used for the inner and outer rings and the gussets. The amount of gusset locations used always equal the number of wood ribs. There is one gusset 7 in-between every rib destination at the lower steel ring, except where a splice assembly occurs. There will be two gussets 8 at each splice assembly (FIG. 1C).

3. The 4 inch steel angle 15 within the lower steel rings 3 does not change. One for each rib 2.

4. The compression ring 2 begins at a 36 inch outside diameter at the 10 foot dome kit and increases after the 16 foot diameter to a 5 foot outside diameter at the 36 foot diameter dome kit.

5. All steel angles, gussets, rib mounting flanges and the compression ring are factory welded. Factory welds are performed by certified welders to meet or exceed the ASTM standards as required.

6. The steel backup plates remain constant and do not change from the 10 foot to the 36 foot diameter dome kit.

7. As seen from FIG. 1A, in an assembled dome structure, there are spaces between adjacent wood ribs 2. The spaces enable mechanical, electrical and/or natural light systems to be located in those spaces, and, if desired, conveniently connected to the ribs.

8. While a preferred Dome Kit includes all hardware components required to assemble a dome shaped structural system, it is believed possible to practice the assembly process and produce a dome shaped structural system from a Dome Kit that includes some hardware components, and has specifications for the other hardware components that can be acquired separately by (or for) the assembler. Additionally, because of the nature of the components that make up a Dome Kit, the components forming part of the Dome Kit may be included in a single package or container (or provided on a pallet with a shrink wrap cover), or may be packaged separately (or not packaged at all), but will be bundled or otherwise provided in a way that makes them all available to an assembler.

Accordingly, as seen from the foregoing description, applicant has provided a new and useful dome kit that can be used to conveniently assemble a new and useful dome structure, by a new and useful method. With the foregoing description in mind, various ways to configure a dome kit, and to assemble a new and useful dome structure will become apparent to those in the art.

PARTS LIST 1. compression ring ¼ inch plate steel×10 inch height, factory rolled and welded
2. wood rib
3. lower steel ring, ¼ inch wide×3 inches height, standard steel
4. splice assembly
5. inner lower ring
6. outer lower ring
7. steel gusset, ¼ inch×3 inch height×11½ inch length, factory welded to lower ring
8. adjoining gussets at ends of ring sections
9. factory welds
10. factory ready bolt holes
11. splice plate, ¼ inch×3 inches×14 inches, standard steel with factory ready bolt holes
12. ⅝ inch standard steel bolt, nut and washers
13. ¼ inch×4 inch depth×8 inch length standard steel rib mounting flange
14. ¼ inch×3 inch depth×8 inch length standard steel backup plate for bolting purposes
15. ¼ inch×4×4 inch×11½ inch length standard steel angle, see FIGS. 3A, 3B, 3C
16. ¼ inch×2 inch×10 inch length standard steel backup plate for bolting purposes
17. dome shaped structural system diameter, outside to outside of lower steel ring 18. dome shaped structural system elevation, from bottom of lower rings to continued arc at top center of compression ring
19. image of dome shaped structural system with elevation being one half the diameter
20. slot in rib

What is claimed is:

1. A kit for use in forming a dome structure, comprising a. a compression ring, b. a plurality of components that are configured to be assembled into a lower ring that is larger than the compression ring and configured to be located below and in spaced relation to the compression ring, the components that are configured to be assembled into a lower ring comprising lower ring sections, each of which includes inner and outer ring parts joined together at predetermined locations, and splice components for use in joining lower ring sections to each other to form a lower ring with inner and outer ring parts, c. a plurality of ribs that are configured to be connected with and to extend between the lower ring and the compression ring, the ribs each having a predetermined shape such that when connected with and extending between the lower ring and the compression ring, provide a structural system with a dome shaped appearance, and d. hardware components for use in assembling the foregoing components.

2. A kit as defined in claim 1, wherein the compression ring includes rib mounting flanges at predetermined locations on the compression ring, and the ribs having slots, the rib mounting flanges being located and configured such that a rib mounting flange can be received by a slot in a rib.

3. A kit as defined in claim 2, wherein a plurality of rib support members are fixed to the lower ring sections at predetermined locations such that when the lower ring is assembled each rib support member can be aligned with a respective rib mounting flange of the compression ring, whereby a rib supported on a rib support member is oriented so that a slot in the rib can conveniently receive the respective rib mounting flange of the compression ring.

4. A kit as defined in claim 3, wherein the rib support members comprise angle members fixed to portions of the lower ring sections.

5. A kit as defined in claim 4, wherein the compression ring is formed of metal, the ring sections are formed of metal, and the ribs are formed of wood.

6. A method of forming a dome shaped structural system, comprising the steps of a. providing a compression ring, b. providing a lower ring with a larger but similar shape to the compression ring, by the steps of splicing together lower ring sections to form the lower ring, c. providing a plurality of ribs formed of wood and configured to extend between the lower ring and the compression ring, d. positioning the compression ring in relation to the lower ring such that the compression ring is above the lower ring and in centered relation to the lower ring, and e. connecting the ribs with the lower ring and the compression ring to form a dome shaped structural system;

wherein the compression ring has a plurality of rib mounting flanges, the lower ring has a plurality of rib support members, the ends of the ribs that are configured to be connected with the compression ring have slots, each of which is configured to be received by a respective rib mounting flange, and wherein the step of connecting the ribs with the lower ring and compression ring comprises positioning each rib with the end of the rib that is opposite to the slot resting on a rib support member and the slot receiving a respective rib mounting flange.

7. A method of forming a dome shaped structural system, comprising the steps of a. providing a compression ring, b. providing a lower ring with a larger but similar shape to the compression ring, by the steps of splicing together lower ring sections to form the lower ring, c. providing a plurality of ribs formed of wood and configured to extend between the lower ring and the compression ring, d. positioning the compression ring in relation to the lower ring such that the compression ring is above the lower ring and in centered relation to the lower ring, and e. connecting the ribs with the lower ring and the compression ring to form a dome shaped structural system;

wherein the compression ring has a plurality of rib mounting flanges, the lower ring has a plurality of rib support members, the ends of the ribs that are configured to be connected with the compression ring have slots, each of which is configured to be received by a respective rib mounting flange, and wherein the step of connecting the ribs with the lower ring and compression ring comprises positioning each rib with the end of the rib that is opposite to the slot resting on a rib support member and the slot receiving a respective rib mounting flange; and wherein the step of providing the lower ring comprises providing a plurality of lower ring sections, each of which includes inner and outer ring parts joined together at predetermined locations, and joining the lower ring sections together to form the lower ring.

* * * * *